United States Patent [19]

Grooss et al.

[11] 4,163,498

[45] Aug. 7, 1979

[54] TOWER ASSEMBLY

[75] Inventors: Frank A. Grooss, Morton; Gerald P. Simmons, Washington, both of Ill.

[73] Assignee: Caterpillar Tractor Co., Peoria, Ill.

[21] Appl. No.: 859,364

[22] Filed: Dec. 13, 1977

[51] Int. Cl.[2] ..... E02F 3/70

[52] U.S. Cl. ..... 414/697; 296/203

[58] Field of Search ..... 214/140; 296/28 R

[56] References Cited

U.S. PATENT DOCUMENTS

| | | | |
|---|---|---|---|
| 3,335,884 | 8/1967 | Termont et al. | 214/140 |
| 3,656,642 | 4/1972 | Kostas et al. | 214/140 |
| 3,963,131 | 6/1976 | Dimmer | 214/140 |
| 4,055,262 | 10/1977 | Bauer et al. | 214/140 |

*Primary Examiner*—Robert G. Sheridan
*Assistant Examiner*—Ross Weaver
*Attorney, Agent, or Firm*—Wegner, Stellman, McCord, Wiles & Wood

[57] ABSTRACT

A wheeled vehicle structure including a frame having laterally spaced rail portions, a working component such as a loader, and arm and control cylinder structure attached to the working component for selective positioning thereof. A prefabricated tower assembly is mounted to the frame in straddling relationship to the spaced rails, with a top portion of the tower assembly resting on a top surface of the rails and a lower side portion of the tower assembly welded to the outer side surfaces of the rails. Shims are provided for accurately locating the tower assembly transversely of the frame and to accommodate for manufacturing tolerances. The tower assembly includes pivot structure for pivotally connecting the arm and control cylinder structure thereto so as to permit ready conversion of the wheeled vehicle to a loader or the like. The tower assembly is fully prefabricated and machined prior to being secured to the vehicle frame and serves to provide improved distribution of the working component loads into the frame.

9 Claims, 3 Drawing Figures

TOWER ASSEMBLY

BACKGROUND OF THE INVENTION

1. Field of the Invention

This invention relates to wheeled vehicles and in particular to means for connecting the arm and control cylinder means associated with a working component to the frame of the vehicle.

2. Description of the Prior Art

In U.S. Pat. No. 3,432,051 of Herbert W. Borer et al, a loader frame for track-type loaders is disclosed for supporting the lift and tilt mechanisms and the bucket of a loader. The vehicle comprises a track-type tractor for supporting the engine and operator station of the loader. The loader support members are connected to the track roller frames by bolts. The operator station is secured to the loader support members by bolts.

In U.S. Pat. No. 3,658,198 of Howard O. Keskitalo, which patent is owned by the assignee hereof, a compact mounting assembly for mounting a bucket in a loader vehicle is shown utilizing pivot brackets formed on respective sides of the vehicle frame. The brackets are integrally secured to the sides of the frame as by welding and are individually attached thereto in the assembly of the vehicle.

SUMMARY OF THE INVENTION

The present invention comprehends the provision in such a vehicle structure of an improved means for mounting the arm and control cylinder means of the working components to the frame of the vehicle. In the illustrated embodiment, the mounting means comprises a prefabricated tower assembly having an upper portion resting on the top surface of the laterally spaced front rail portions of the frame and a lower portion welded to the outer side surfaces of the frame rail portions.

The welding of the tower assembly to the frame is terminated adjacent the top surface of the frame, leaving the top surface free of securement so as to avoid stress concentration and provide an improved mounting of the tower assembly to the frame.

The tower assembly is completely prefabricated and machined prior to its installation on the spaced frame portions so as to facilitate manufacture of the vehicle assembly. By prefabricating the tower assembly, an accurate connection of the working component may be readily effected.

Shims may be provided for accurately positioning the tower assembly transversely of the frame so as to facilitate a centered disposition of the tower assembly on the frame, and to accommodate for manufacturing tolerances. The entire assembly may be readily installed as a unit and positioned longitudinally of the frame in being set in place on the frame with the tower assembly effectively straddling the frame in a generally downwardly opening U-shaped configuration.

The mounting means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
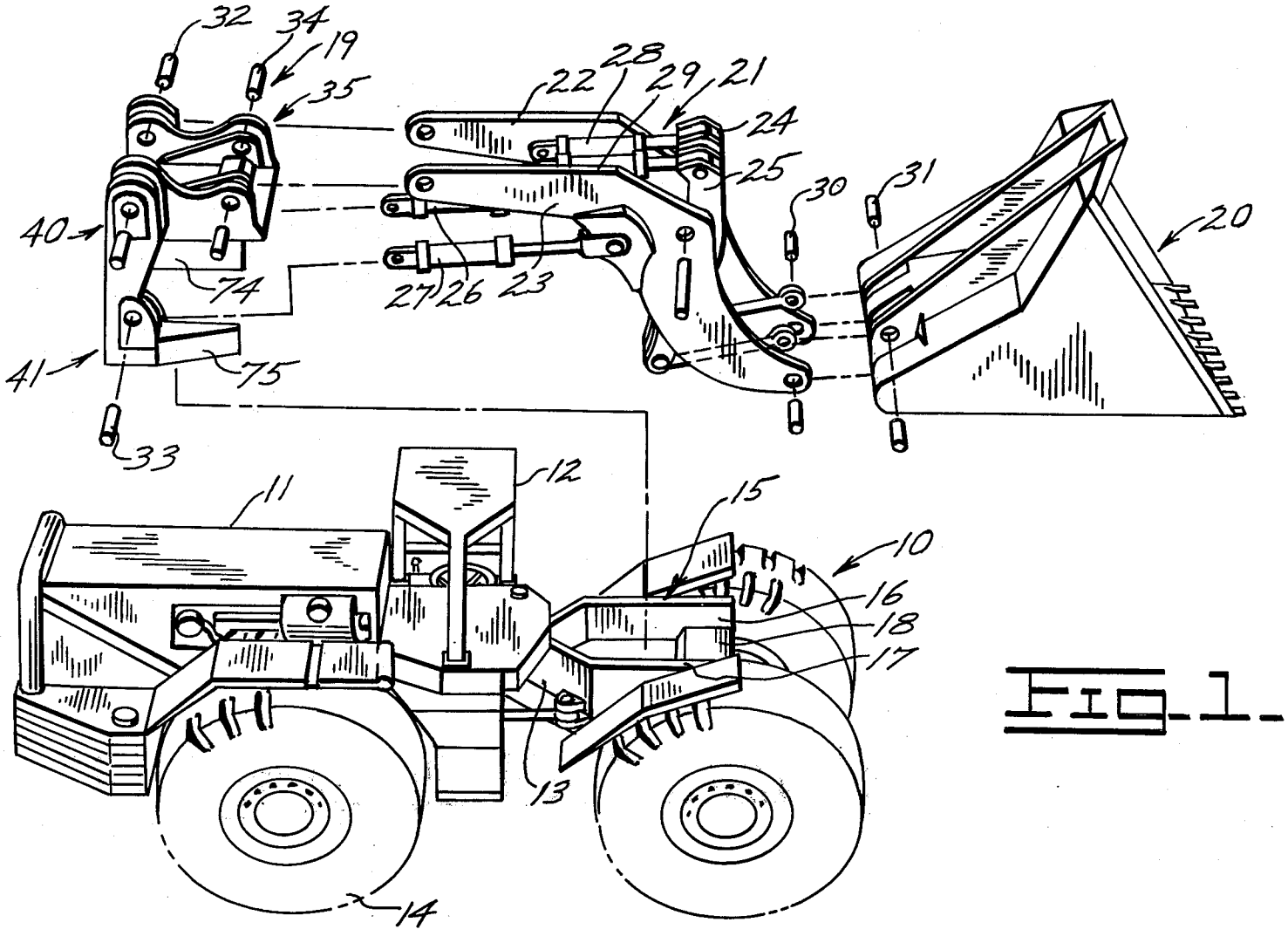
FIG. 1 is an exploded perspective view of a vehicle having a tower assembly embodying the invention for connecting the arm and control cylinder means of a working element, such as a loader, to the vehicle.

In the exemplary embodiment of the invention as disclosed in the drawing, a wheeled vehicle generally designated 10 is shown to include an engine 11 and an operator's station 12 carried on a frame 13. The frame is supported by a plurality of wheels 14, and as shown in FIG. 1, the vehicle generally defines a wheeled tractor vehicle.

Frame 13 defines a front portion generally designated 15 having a pair of front portions 16 and 17 spaced transversely of the vehicle. Frame portions 16 and 17 comprise front rail portions of the frame maintained in accurate spaced relationship by a crosspiece 18 at the front of the vehicle.

The invention comprehends an improved means generally designated 19 for mounting a working component, such as a loader, 20 having associated arm and control cylinder means generally designated 21 in the vehicle. When so mounted to the frame portions 16 and 17, the vehicle effectively defines a low profile loader, such as for use in mine operation and the like. The invention comprehends the facilitated installation of the mounting means 19 on the frame 15 so as to provide facilitated conversion of existing machines to form such earthworking apparatuses when desired. The use of the improved mounting means 19 permits such conversion with minimum modification of the vehicle.

More specifically, as shown in FIG. 1, the arm and control cylinder means includes a pair of lift arms 22 and 23, a pair of tilt arms 24 and 25, a pair of lift cylinders 26 and 27, and a pair of tilt cylinders 28 and 29. The lift arms are pivotally connected to the loader bucket 20 by suitable pivot pins 30 and tilt arms 24 and 25 are connected to the bucket by suitable pivot pins 31. The lift arms 22 and 23 are pivotally connected to the mounting means 19 by suitable pivot pins 32. The lift cylinders which are pivotally connected to a midportion of the lift arms are pivotally connected to the mounting means 19 by pivot pins 33, and the tilt cylinders 28 and 29 which are pivotally connected to the tilt arms 24 and 25 are pivotally connected to the mounting means 19 by pivot pins 34.

Figure 2:
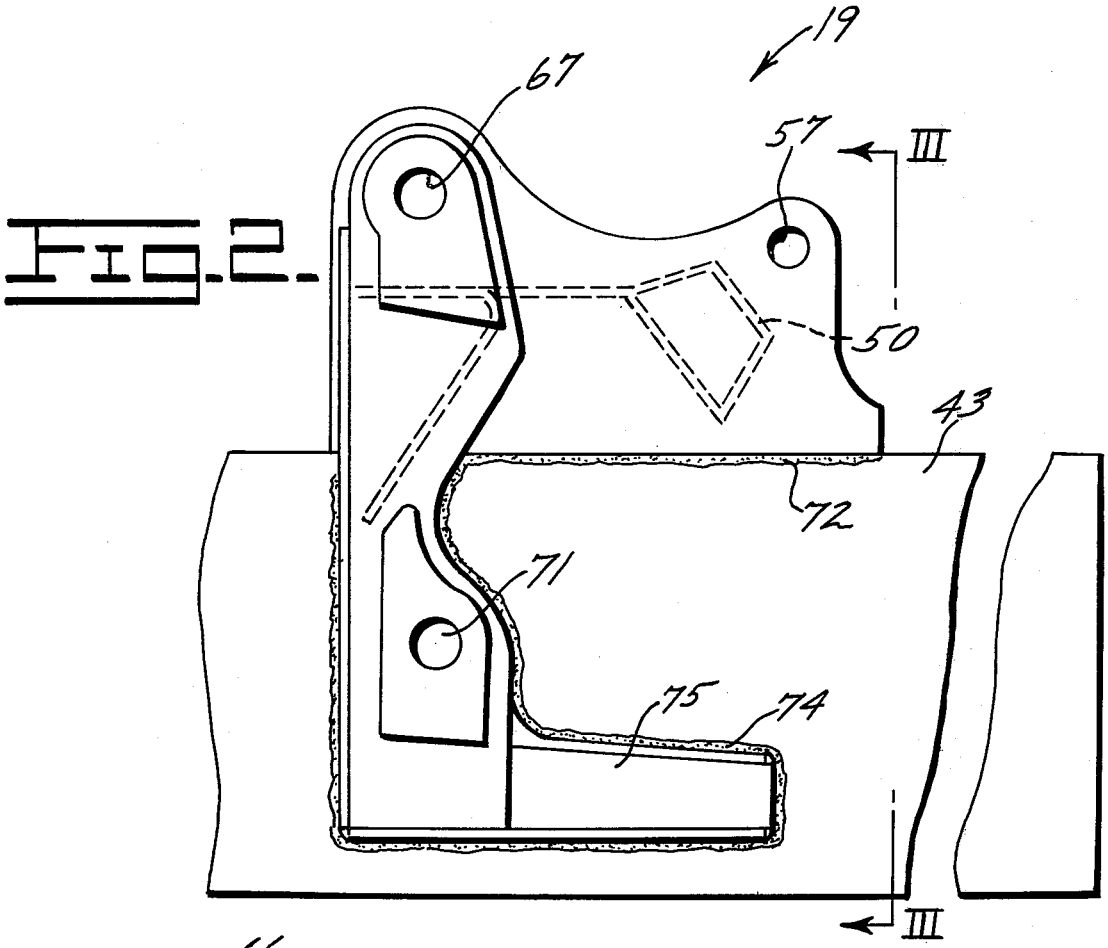
FIG. 2 is a fragmentary side elevation of the tower assembly mounted on the frame.
Figure 3:
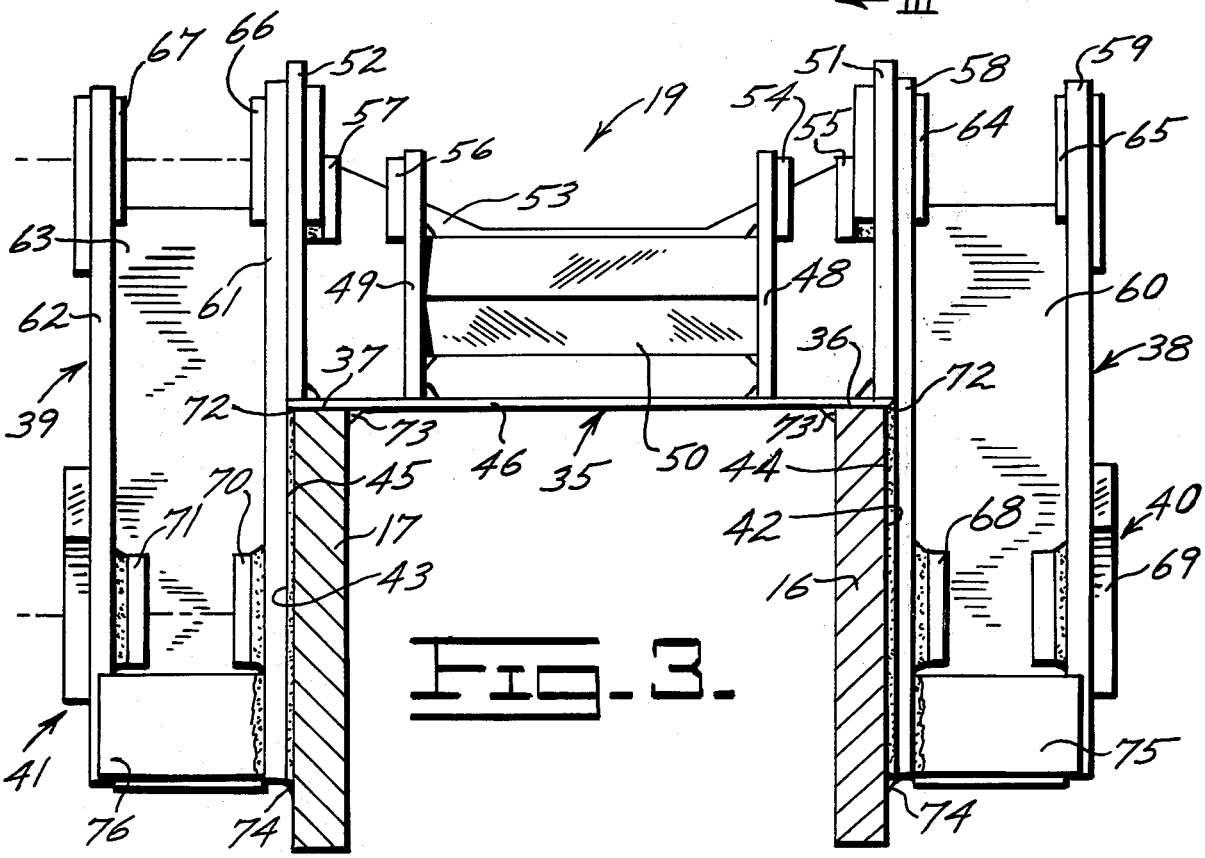
FIG. 3 is a fragmentary transverse section taken substantially along the line 3—3 of FIG. 2.

The construction of the mounting means 19 might best be seen by reference to FIGS. 2 and 3. As shown therein, the mounting means defines a generally U-shaped tower assembly having an upper portion generally designated 35 resting on the top surfaces 36 and 37 of frame rail portions 16 and 17. The tower assembly further includes side portions generally designated 38 and 39 defining lower portions 40 and 41, respectively, extending transversely outwardly of the frame portions 16 and 17. Lower side portions 40 and 41 are spaced outwardly of the outer surfaces 42 and 43 of the frame portions 16 and 17 by suitable spacers 44 and 45 so as to accurately position the tower assembly 19 transversely of the frame, and to accommodate for manufacturing tolerances.

As best seen in FIG. 3, upper portion 35 of the tower assembly 19 includes a lower plate 46 provided with upstanding walls 48 and 49 retained in accurate spaced-apart relationship by a spreader 50. Upper portion 35 further includes a pair of outermost upstanding walls 51 and 52. As shown in FIG. 3, walls 48, 49, 51 and 52 may be welded to the bottom plate 46 and a transverse rear plate 53 may be provided to extend between the end walls 51 and 52 and define a rigid box construction of the tower assembly upper portion 35. As further shown in FIG. 3, walls 48 and 51 define a pair of pin journals 54 and 55, and walls 49 and 52 define a pair of pin journals 56 and 57 for coaxially receiving the tilt arm cylinder pivot pins 34.

Side portion 38 is defined by an inner wall 58 and an outer wall 59 maintained in spaced-apart relationship by a transverse plate 60. The left side wall portion 39 is defined by an inner wall 61 and an outer wall 62 maintained in spaced-apart relationship by a transverse plate 63.

As further shown in FIG. 3, walls 51 and 58 cooperatively define a pivot pin journal 64 and wall 59 defines a pivot pin journal 65. Walls 52 and 61 cooperatively define a pivot pin journal 66 and wall 62 defines a pivot pin journal 67. Wall 58 further defines, in the lower portion of side portion 38, a lower pivot pin journal 68, and wall 59 defines a lower pivot pin journal 69. The lower portion of wall 61 defines a pivot pin journal 70 and the lower portion of wall 63 defines a pivot pin journal 71. Pivot pin journals 64 and 65 are coaxially aligned and pivot pin journals 66 and 67 are coaxially aligned to receive the lift arm pins 32, as shown in FIG. 1.

The pivot pin journals 68, 69, 70 and 71 are coaxially aligned to receive pivot pins 33 for connecting the lift cylinders 26 and 27 to the tower assembly.

The tower assembly 19 is prefabricated and premachined so as to provide accurate location of the journals for accurate connection of the lift arm, tilt arm, lift cylinder and tilt cylinder means of the connecting structure 21. Such performing of the tower assembly permits facilitated installation thereof in the vehicle by simply placing the assembly in straddling relationship to the front portion 15 of frame 13 with the lower portions 40 and 41 thereof spaced slightly outwardly of the outer surfaces 42 and 43 of the rail portions 16 and 17. As shown in FIG. 3, in this disposition, the bottom plate 46 of the upper portion 35 rests on the upper surfaces 36 and 37 of the frame portions 16 and 17. As shown in FIG. 2, the portion of the plate 46 resting on surfaces 36 and 37 is free of any securement thereto so as to avoid stress concentrations at this location.

With further reference to FIG. 2, the top portion plate 46 is secured to the sidewall surfaces 42 and 43 by a longitudinal weld 72. The underside of the plate 46 is secured to the inner sidewall surfaces of the frame portions 16 and 17 by an inner weld 73, as shown in FIG. 3. As further shown in FIGS. 2 and 3, the inner walls 58 and 61 of the tower assembly are secured to the outer surfaces 42 and 43 of the frame by a continuous weld 74. The lower portions 40 and 41 of the tower assembly are provided with a pair of forwardly projecting wedge-shaped sections 75 and 76, which are secured to the frame surfaces 42 and 43 by the weld 74 as a part of the lower portion of the tower assembly.

The wedge-shaped elements 75 and 76 extend rearwardly to between the pair of plates 58,59 and pair of plates 61,62 to provide a strong base support for the tower assembly and thus provide a strong support for connection of the arm and control cylinder means 21 to the frame. In the illustrated embodiment, the spacing between walls 58 and 59 and the spacing between walls 61 and 62 is of sufficient thickness so that the rear portion of the elements 75 and 76 comprises a section of like thickness providing high strength in the assembly.

As further shown in FIGS. 2 and 3, the different wall portions of the tower assembly are lapped over so as to provide for improved strength in the welding thereof to the frame and to each other in the assembly. The welding of the tower assembly to the frame portions may be done suitably sequentially, as will be obvious to those skilled in the welding art, so as to prevent distortion of the tower assembly and the frame in the securing of the tower assembly thereto.

The foregoing disclosure of specific embodiments is illustrative of the broad inventive concepts comprehended by the invention.

The embodiments of the invention in which an exclusive property or privilege is claimed are defined as follows:

1. In a wheeled vehicle having a frame provided with laterally spaced front rail portions each defining a side and a top, a working component, and arm and control cylinder means attached to the working component for selective positioning of the working component, improved means for mounting said arm and control cylinder means to the frame comprising:

a prefabricated substantially U-shaped tower assembly having lower portions laterally adjacent said spaced rail portion sides and an upper portion overlying the space between said rail portions and supported on said tops thereof;

means removably pivotally connecting said arm and control cylinder means to the tower assembly; and securing means fixedly securing said tower assembly lower portions to said sides of said spaced rail portions, and said tower assembly upper portion to said tops of said spaced rail portions.

2. The wheeled vehicle structure of claim 1 wherein a shim is provided between at least one of said rail portions and the associated tower assembly lower portion for accurately positioning the tower assembly transversely of said frame, and for accommodating for manufacturing tolerances.

3. The wheeled vehicle structure of claim 1 wherein said securing means comprises weld means.

4. The wheeled vehicle structure of claim 1 wherein said securing means comprises weld means including welds at each of the opposite sides of the top of each said rail portion.

5. The wheeled vehicle structure of claim 1 wherein said securing means comprises weld means including welds between the bottom of the tower assembly lower portion and the sides of said rail portions.

6. The wheeled vehicle structure of claim 1 wherein said tower assembly defines at least six pivot means for connection thereto of said arm and control cylinder means.

7. The wheeled vehicle structure of claim 1 wherein said tower assembly defines pivot means for connection thereto of said arm and control cylinder means, each said pivot means including a pair of spaced supports having aligned holes and a pivot pin extending through said holes and receiving a portion of the arm and control cylinder means between said supports.

8. The wheeled vehicle structure of claim 1 wherein said securing means comprises weld means between said tower assembly upper portion and the sides of said front rail portions and terminating adjacent said top surface to permit said top surface to be free of securement of said tower assembly.

9. The wheeled vehicle structure of claim 1 wherein said tower assembly includes distributed stiffening means.

* * * * *